362805 0619 -00 12-29-81 36501

11-25-81 182635 78147 0 04308079 1793

United States Patent [19]

Venables et al.

[11] 4,308,079

[45] Dec. 29, 1981

[54] DURABILITY OF ADHESIVELY BONDED ALUMINUM STRUCTURES AND METHOD FOR INHIBITING THE CONVERSION OF ALUMINUM OXIDE TO ALUMINUM HYDROXIDE

[75] Inventors: John D. Venables, Baltimore; Maher E. Tadros, Ellicott City; Brian M. Ditchek, Columbia, all of Md.

[73] Assignee: Martin Marietta Corporation, Bethesda, Md.

[21] Appl. No.: 160,052

[22] Filed: Jun. 16, 1980

[51] Int. Cl.³ ..... C23F 7/14

[52] U.S. Cl. ..... 148/6.15 R; 148/31.5

[58] Field of Search ..... 148/6.15 R, 31.5

[56] References Cited

U.S. PATENT DOCUMENTS

| | | | |
|---|---|---|---|
| 3,634,146 | 1/1972 | Wystrach | 148/6.15 R |
| 3,900,370 | 8/1975 | Germscheid et al. | 148/6.15 R |
| 4,252,857 | 2/1981 | Heine et al. | 428/411 |

*Primary Examiner*—Ralph S. Kendall

*Attorney, Agent, or Firm*—Gay Chin; Herbert W. Mylius

[57] ABSTRACT

It has been found that hydration of aluminum oxide surface coatings to aluminum hydroxide may be curtailed by the presence of corrosion inhibiting amounts of amino phosphonate compounds. Effective inhibitors, such as nitrilotris (methylene) triphosphonic acid, may be applied to aluminum substrates having aluminum oxide surfaces thereupon in concentrations of less than 50% by weight in aqueous solution, and suitably from 1 to about 500 ppm.

42 Claims, 4 Drawing Figures

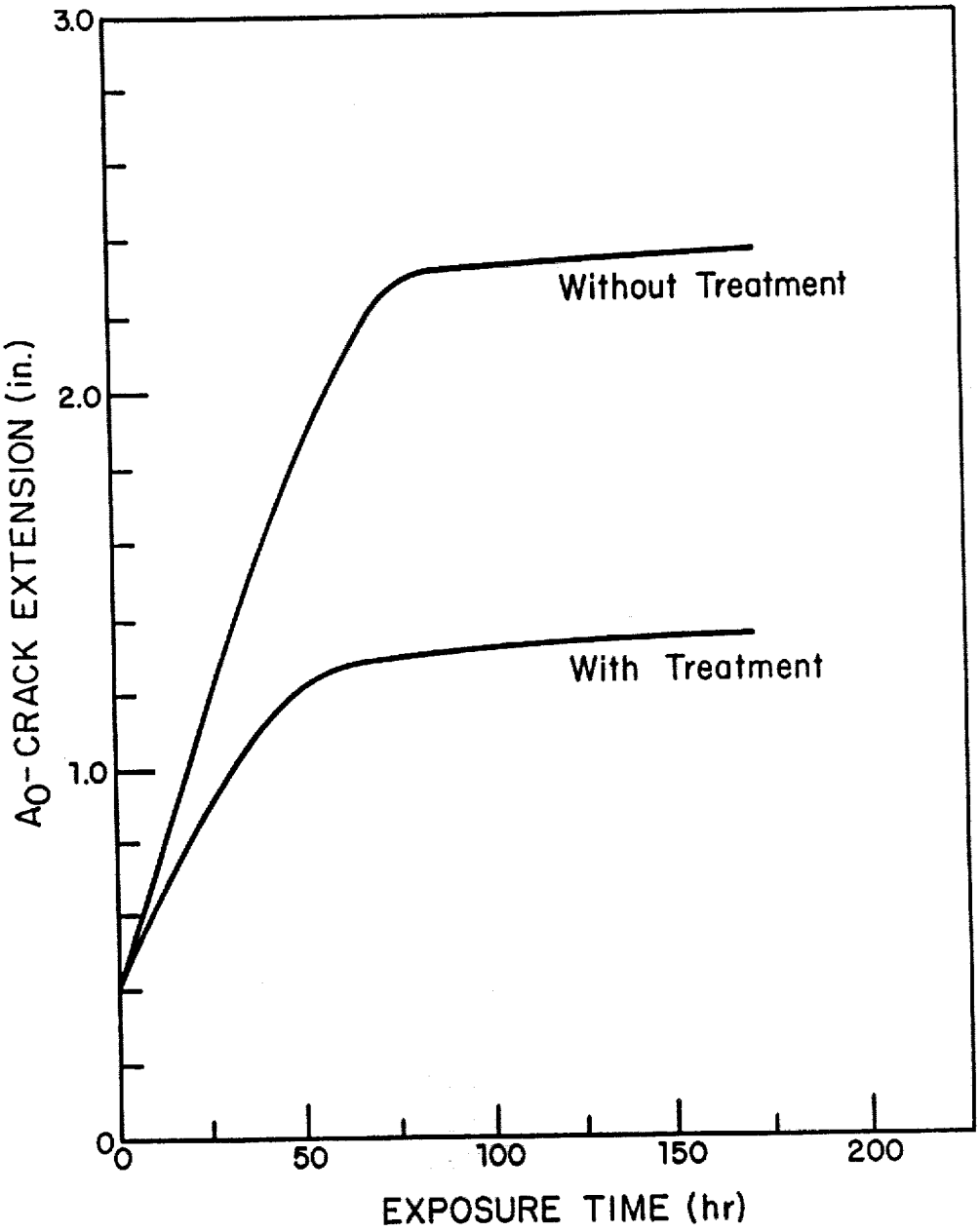
FIG. 4 WEDGE TEST RESULTS

DURABILITY OF ADHESIVELY BONDED ALUMINUM STRUCTURES AND METHOD FOR INHIBITING THE CONVERSION OF ALUMINUM OXIDE TO ALUMINUM HYDROXIDE

BACKGROUND OF THE INVENTION

This invention relates to methods of improving adhesively bonded aluminum structures, and to a method for inhibiting the conversion of aluminum oxide to aluminum hydroxide.

In the past, many processes have been described for treatment of aluminum surfaces in preparation for subsequent painting, adhesive bonding, and the like. The general intent of these preparation procedures is to modify the original surface as it comes from the mill so that it is (i) more suitable for developing strong bonds to polymeric materials and/or (ii) more environmentally stable against the effects of moisture and humidity.

The degree of success achieved to meet these goals varies considerably depending upon the process. For example, the Forest Products Laboratory (FPL) process, which consists of etching the aluminum in an aqueous sodium dichromate sulfuric acid solution, has been used extensively in the aircraft industry because it provides a rough surface oxide on the aluminum, which interlocks with the adhesive to form a strong bond, as shown by Venables et al. (J. D. Venables, D. K. McNamara, J. M. Chen, T. S. Sun, and R. L. Hopping, Appl. Surface Science 3, 88, 1979). Since the protective oxide is very thin (200–400 A), however, structures made using this process tend to be relatively unstable when brought into contact with moisture. On the other hand, chemical conversion coatings, which usually involve treatment with a highly acid solution containing one or more species of chromate, provide a form of chromium hydroxide surface which is highly resistant to environmental moisture and humidity, but which bonds with only marginal strength to polymeric coatings because of its relative smoothness. Thus, conversion coatings are successfully used under paints, but are not generally used for adhesively bonded structural components requiring a great deal of bond strength. In addition, environmental concerns have severely restricted the discharge of waste chemicals into waterways and sewage treatment facilities. Such restrictions normally require complete after-treatment of spent chemical conversion coating solutions, thus greatly increasing costs.

Another process, that of phosphoric acid anodization (PAA), discussed in U.S. Pat. No. 4,085,012 and 4,127,451, improves upon this situation by providing an oxide film on aluminum, which is both rougher and, at the same time, considerably thicker (2000–4000 A) than that provided by the FPL process. Since the effect is to provide good bond strength and also improved environmental stability, the process has become popular for use in the aircraft industry.

For those materials prepared by the FPL or PAA process for use in adhesively bonded structural aircraft components, the aluminum oxide coating formed during the treatment serves as a barrier, resisting corrosion and subsequent delamination of the structure. The effectiveness of this barrier, however, is compromised by the fact that when the aluminum oxide is subjected to a humid or moist environment, it transforms with time to a hydrated material known as pseudo-boehmite whose formula is approximately $Al_2O_3.2H_2O$. This transformation is undesirable because (i) the change in chemistry is accompanied by a drastic change in shape or morphology, and (ii) pseudo-boehmite is not as tenaciously adherent to aluminum as is aluminum oxide. The effect of the transformation from aluminum oxide to aluminum hydroxide therefore is to destroy the interlocking grip between the oxide and adhesive (or primer) as the morphology changes, and to further weaken the bond strength due to the inherent lack of adequate interfacial strength between aluminum and pseudo-boehmite. Thus, although there may be differences in degree between the environmental stability of aluminum surfaces prepared by, for example, the FPL and PAA processes, they are subject to the same eventual degradation mechanism since the surface aluminum oxide in both cases hydrates in the presence of water.

The degradation of surface aluminum oxide structures is especially critical in composite assemblies used in the aircraft industry and elsewhere. For example, in aircraft construction, wing structures frequently utilize adhesively bonded aluminum materials which are subjected to temperature extremes varying from arctic cold to tropical heat, as well as exposure to varying atmospheric pressures and moisture content. To ensure safety, and to avoid failure of aircraft structures, bonded metal-to-metal and composite assemblies must be able to withstand extreme environmental conditions, as well as conditions of extreme flex and stress. A particular concern is resistance to corrosion and delamination of adhesively bonded structures under conditions of high humidity.

SUMMARY OF THE INVENTION

The present invention relates to stabilizing the aluminum oxide surface coating of an aluminum substrate by treating said aluminum oxide with an additive to retard hydration thereof to aluminum hydroxide, thus providing a more stable, microporous surface which is particularly well suited to commercial adhesive techniques. This invention contemplates treating the aluminum oxide surface with amino phosphonate compounds such as nitrilotris (methylene) triphosphonic acid, $N[CH_2PO(OH)_2]_3$. It has been discovered that treatment of the aluminum substrate by dipping or spraying with an aqueous solution of nitrilotris (methylene) triphosphonic acid in concentrations ranging from about 0.0001% to 50% by weight results in the deposition of a partial monomolecular layer of the hydration inhibitor, which is sufficient to protect aluminum oxide from hydration to aluminum hydroxide, but does not inhibit mechanical linkage to the oxide by organic materials such as adhesives, primers or paints. By preventing the conversion of aluminum oxide to aluminum hydroxide on the surface of the aluminum in this manner it is observed that the durability of adhesive bonds made to aluminum can be improved significantly, both for aluminum-to-aluminum bonds and for bonding aluminum to other materials.

Thus, an objective of the invention is to provide a means whereby the hydration rate of oxides on the surfaces of aluminum is drastically reduced by the application of a monomolecular layer of an inhibitor that adheres tenaciously to the aluminum oxide and does not interfere with the normal bonding process between the oxide and overlaying adhesives or primer. It is a further object of this invention to prepare adhesively bonded aluminum or aluminum alloy structures, wherein the adhesive/aluminum interface exhibits improved stability in a moist environment. It is yet a further object of this invention to provide a method for forming adhesively bonded aluminum structures in which adhesive failures due to exposure to humidity are minimized, particularly at the adhesive/aluminum interface.

It is another purpose of this invention to provide a method for the inhibition of corrosion of aluminum substrates. It is a still further object of the present invention to inhibit the conversion of aluminum oxide to aluminum hydroxide.

BRIEF DESCRIPTION OF THE DRAWINGS

FIG. 4 represents a graphic comparison of wedge test results for aluminum adherends with and without inhibitor treatment after FPL process treatment.

PREFERRED EMBODIMENTS OF THE INVENTION

Figure 1:
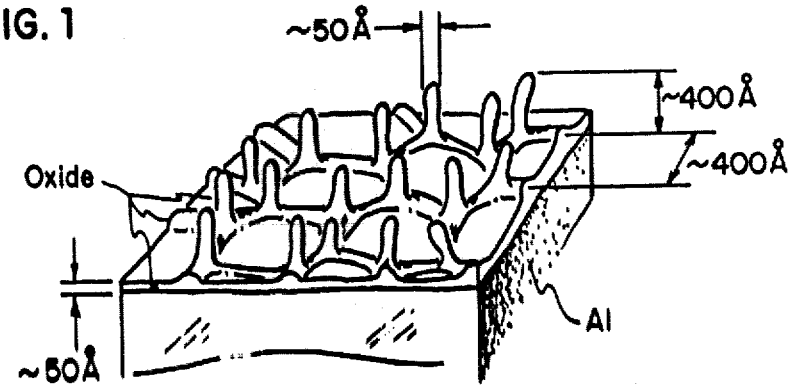
FIG. 1 represents an isometric drawing of the normal oxide morphology on an aluminum surface treated by the FPL process.

The major disadvantage of aluminum and most aluminum alloys is susceptibility to degradation by hydration of the protective oxide and subsequent corrosion. Various primers, paints, coatings, etc., have been developed to protect the metal, but none to date have proven entirely successful. This problem is particularly severe in high performance applications such as adhesively bonded aircraft structures, where hydration/corrosion may cause serious degradation in bond strength with potentially catastrophic consequences. We have now found that the hydration/corrosion process is inhibited by the use of specific adsorbates which may be readily applied as a partial molecular monolayer on aluminum, or more correctly, on the aluminum oxide layer which is inherent to aluminum substrates. It has been observed that the corrosion of aluminum is possible because the protective oxide, which forms naturally, or can be made to form chemically or by anodization, readily converts to a much less protective aluminum hydroxide coating in the presence of water or moisture. It has now been found that amino phosphonate compounds such as nitrilotris (methylene) triphosphonic acid, which adsorb tenaciously to aluminum oxide, act as a very effective inhibitor of the hydration/corrosion process, particularly when used on aluminum prepared with porous oxide morphologies that provide interlocking with adhesives or primers to form high bond strengths in adhesively bonded structures. Because of the extreme thinness of the adsorbed inhibitor coating (one molecule thick, or less), its use will not interfere with the normal interlocking that occurs between the rough oxide and an adhesive or paint layer. The stability of adhesively bonded aluminum structures in a high humidity environment has been studied using the so-called "wedge-test". This test is performed on samples consisting of two strips of aluminum bonded together with an adhesive such as an epoxy. After bonding, a wedge is inserted at the bond line, thus providing a stress tending to slowly separate the two aluminum strips. The rate at which the crack extends along the bond line is then measured as a function of temperature and humidity in order to evaluate the stability of the bond. A detailed examination of crack interfaces generated in this manner has yielded a great deal of information regarding the mechanism of failure in a moist environment. In particular, it has been observed that in conventionally FPL or PAA treated and bonded aluminum laminates:

(1) The crack initially propagates through the adhesive before the sample is introduced into a humidity chamber;

(2) After the sample is exposed to a warm, humid environment (150° F., 95% relative humidity), the crack path changes to one that propagates along the adhesive/aluminum interface;

(3) An examination of the *adhesive* side of the crack interface reveals that the region exposed during the humidity test is for the most part covered with a thin layer of aluminum hydroxide. This identification has been made using scanning transmission electron microscopy (STEM) and Auger/ESCA. Thus, when the surface is examined in the scanning electron microscope mode it is observed that the adhesive surface is almost completely covered with a material that exhibits a morphology identical to that identified by Veddar and Vermilyea ("Aluminum and Water Reaction," Trans. Faraday Soc. 65, p. 561, 1969) as pseudo-boehmite ($Al_2O_3.2H_2O$). In addition, the Auger/ESCA technique has further verified that the material on the adhesive side of the crack is aluminum hydroxide.

(4) Evidently, the aluminum hydroxide layer adhering to the adhesive was formed directly from the microscopically rough aluminum oxide surface formed by the Forest Products Laboratory treatment. This finding is particularly significant, since it suggests that adhesively bonded structures degrade in the presence of a warm, humid environment simply due to the conversion of the original oxide on the aluminum substrate to aluminum hydroxide. As the conversion process takes place, a relatively rapid separation occurs at the bond line because of the poor adherence between the hydroxide and the aluminum, and the accompanying drastic change in morphology and layer thickness which further disrupts the bond strength.

(5) The use of amino phosphonates such as nitrilotris (methylene) triphosphonic acid as an adsorbate on the aluminum oxide surface has been found to limit the conversion of oxide to hydroxide, thus significantly reducing the rate of crack extension in wedge testing.

It has thus become evident that the use of this inhibitor, which prevents or retards the conversion of aluminum oxide to aluminum hydroxide, improves the stability of aluminum in moist environments. Although such inhibition is particularly beneficial for adhesively bonded structures of the type used in the aircraft industry, similar benefits would be realized also in other applications, such as painted aluminum panels, where it is desired to prevent degradation in bond strength between the overcoating and the aluminum substrate.

Figure 2:
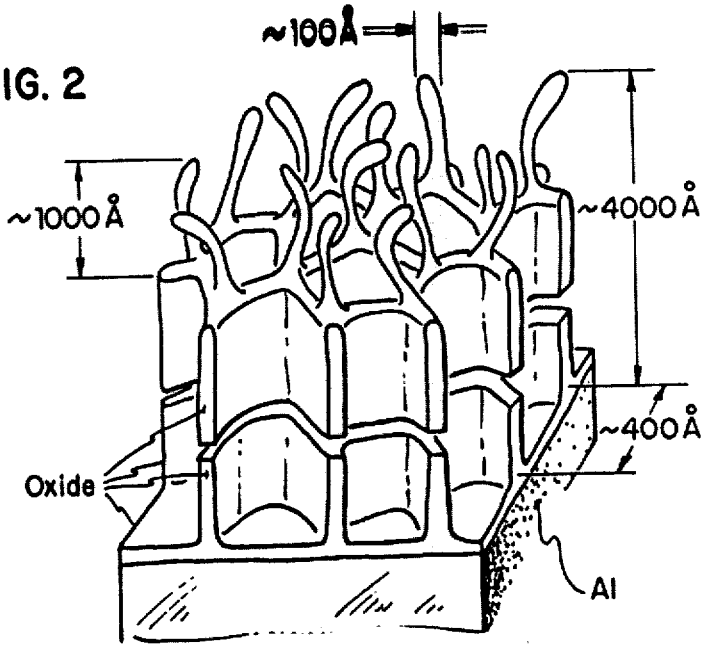
FIG. 2 represents an isometric drawing of the normal oxide morphology on an aluminum surface treated by the PAA process.
Figure 3:
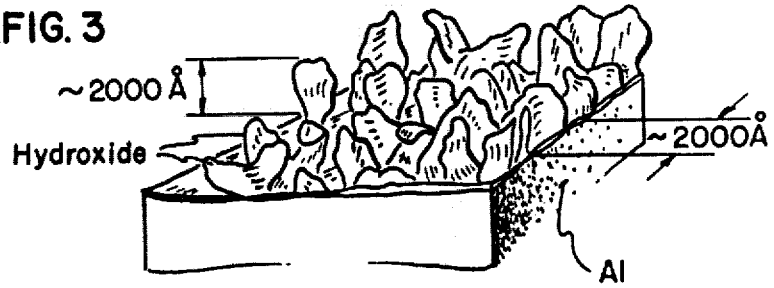
FIG. 3 represents an isometric drawing of the morphology of a hydrated surface resulting when the oxide surfaces of FIGS. 1 or 2 are subjected to moisture.

In the particular case of aircraft-type adhesively bonded aluminum structures, however, consideration must be given to the fact that the inhibitor may not interfere with the role of the oxide morphology in promoting good bond strength. Those pretreatments which are given to aluminum adherents before bonding, such as the FPL or PAA process, serve to promote the formation of a surface oxide which consists of a whisker-like structure, such as shown in FIGS. 1 and 2, which interlocks with the adhesive to form a strong "fiber reinforced" bond. An ideal inhibitor, therefore, is one that prohibits the conversion of the microscopically rough oxide to a hydroxide, such as illustrated in FIG. 3, but does not prevent the oxide from interlocking with the adhesive. It is also noted that the use of corrosion inhibiting paint primers is a less than ideal solution to the problem, since conventional primers are so thick that they cover up the oxide morphology, thus preventing the adhesive (which overlays the primer) from interlocking with the oxide whiskers.

It has now been found that amino phosphonates such as nitrilotris (methylene) triphosphonic acid cling tenaciously in monomolecular form to aluminum oxide and serve to prevent the conversion of the oxide to hydroxide when the surface is later exposed to a moist or wet environment. Since the amount of inhibitor involved is only a monolayer or less on the surface, the inhibitor will not interfere with mechanical interlocking between the oxide and the adhesive. Accordingly, this inhibitor does not degrade initial bond strengths, but increases long term durability of the adhesively bonded structures by preventing conversion of the oxide to a less adherent hydroxide. The inhibitor may be most conveniently applied as a water solution, as by dipping, spraying, or washing, followed by rinsing and drying. Concentrations of the inhibitor in water may range very broadly, from about 1 part per million, up to about 50% or more by weight, with lower concentrations having been found to be most effective. A suitable range has been found to be from about 1 to about 500 ppm, with a preferred range of from about 10 to about 300 ppm, with about 150 ppm being most preferred. However, as previously noted, the inhibitors of this invention are effective in concentrations up to 50% or more. The inhibitor treatment is preferably conducted at about room temperature, although temperatures up to about 80° C. are also suitable.

It has been found that in addition to nitrilotris (methylene) triphosphonic acid, $N[CH_2PO(OH)_2]_3$ other amino phosphonates have the desired inhibiting effect. Exemplary are compounds having the general formulae $NR_3$, $NHR_2$, $NH_2R$, $NRR'_2$, $NR_2R'$, $NHRR'$, $(CH_2NR_2)_2$, and $R_2NCH_2CH_2NRCH_2CH_2NR_2$, wherein R represents the radical $CH_2PO(OH)_2$, and R' is a straight chain alkyl group having from 1 to 5 carbons. Specific examples include $NH[CH_2PO(OH)_2]_2$, $NH_2[CH_2PO(OH)_2]$, $(CH_2N[CH_2PO(OH)_2]_2)_2$, $CH_3N[CH_2PO(OH)_2]_2$, and $[CH_2PO(OH)_2]_2NCH_2CH_2N[CH_2PO(OH)_2]CH_2CH_2N[CH_2PO(OH)_2]_2$.

The invention has been demonstrated by preliminary tests on panels of 2024-T3 and 2219-T87 aluminum which have undergone standard pre-bond processes such as Forest Products Laboratory (FPL) or phosphoric acid anodization (PAA) pre-treatment, and have been immersed in an aqueous solution of nitrilotris (methylene) triphosphonic acid. The initial effect of the corrosion inhibitor on the surface was determined by examination with scanning transmission electron microscopy (STEM) and Auger/ESCA. The results of this analysis indicated that the oxide retained the same morphology as that which characterized the material without the inhibitor. This demonstrated that the inhibitor did not plug up the original surface morphology, thus indicating the availability of the "whiskers" or surface roughness of the aluminum oxide for interbonding with a subsequently applied adhesive. In addition, Auger analysis indicated that the oxide surface on the Forest Product Laboratory pre-treated samples retained up to a 60% monolayer coverage by the nitrilotris (methylene) triphosphonic acid. Identically treated phosphoric acid anodized surfaces were found to retain a similar amount of the inhibitor.

EXAMPLE I

Samples of 2024-T3 aluminum were obtained, having a FPL process oxide surface. Examination of these surfaces demonstrated a microscopic roughness, as illustrated by FIG. 1, having an oxide with "whiskers" or "tendrils" extending about 400 A above the aluminum surface. Some of these samples were soaked in a 20 percent by weight aqueous solution of nitrilotris (methylene) triphosphonic acid for two minutes at room temperature, rinsed thoroughly in distilled water, and air dried. Scanning electron microscope photographs of these treated surfaces, at a magnification of 50,000, show no damage to the finger structure. ESCA analysis of the surfaces indicate a surface coverage of the phosphonic acid molecule of approximately 30%.

Treated and untreated (by inhibitor) samples were then immersed in water at 80° C., removed at various time intervals, and examined by STEM to determine the incubation time before the onset of hydration when the original oxide structure converts to the hydroxide structure shown in FIG. 3. The results demonstrated that the oxide surfaces unprotected by the inhibitor convert to the hydroxide form in approximately two minutes under these accelerated test conditions. On the other hand, no evidence for oxide-to-hydroxide conversion was observed on the surfaces treated with the inhibitor until after six hours of immersion in the hot water. It is evident that the effect of the inhibitor, when applied in this manner, is to improve the stability of the FPL prepared surface by a factor of approximately 180.

EXAMPLE II

Samples of 2024-T3 aluminum were obtained having a PAA process oxide surface. Examination of these surfaces demonstrated a microscopic roughness, as shown in FIG. 2. Some of these samples were soaked in a 20% by weight aqueous solution of nitrilotris (methylene) triphosphonic acid for two minutes at room temperature, rinsed thoroughly in distilled water, and air dried. STEM micrographs of these treated surfaces at a magnification of 50,000 show no damage to the rough oxide structure. ESCA analysis of the surfaces indicated a surface coverage of the phosphonic acid molecule of approximately 20%.

The treated and untreated samples were then immersed in water at 80° C., removed at various time intervals, and examined by STEM to determine when the samples hydrated as evidenced by the presence of the structure shown in FIG. 3. The results demonstrated that the samples untreated with the inhibitor fully hydrate in 15 minutes, whereas those treated with the inhibitor hydrate only after 2 hours immersion in the hot water. Evidently, the effect of the inhibitor when applied in this manner is to improve the stability of the PAA prepared surfaces by a factor of approximately eight.

EXAMPLE III

Samples of 2024-T3 aluminum were obtained having an FPL process oxide surface. Some samples were soaked in a 0.015 percent by weight aqueous solution of nitrilotris (methylene) triphosphonic acid for 30 minutes at 80° C. and then air dried. STEM micrographs of the treated surfaces at a magnification of 50,000 showed no damage to the oxide structure. ESCA analysis of the treated surfaces indicated a surface coverage of the phosphonic acid molecule of approximately 60%.

The treated and untreated samples were then immersed in water at 80° C., removed at various time intervals, and examined to determine when the samples hydrated as evidenced by the presence of the structure shown in FIG. 3. The results demonstrated that the samples untreated with the inhibitor fully hydrate in 2 minutes, whereas those treated with the inhibitor in the above manner hydrate only after approximately 19 hours immersion in the hot water. Evidently the effect of the inhibitor when applied in this manner is to improve the stability of the FPL prepared surface by a factor of 570.

EXAMPLE IV

Samples of 2219-T87 aluminum were obtained having a surface that had been cleaned with a SMUT-GO #1 treatment according to the manufacturers directions (SMUT-GO #1 is manufactured by Turco Products, Division of Purex Corp.). Some of the samples were then soaked in a 0.015 percent by weight aqueous solution of nitrilotris (methylene) triphosphonic acid for 30 minutes at 80° C. and then air dried. Samples treated and untreated with the inhibitor were then exposed to the environment of a humidity chamber in which the temperature and humidity were maintained at 72° C. and 100% R.H., respectively. After 48 hours exposure it was observed by visual examination that the samples treated with the inhibitor were unchanged in appearance, whereas those not receiving the inhibitor treatment were covered with a dark, crusty, corrosion scale.

EXAMPLE V

To test the effectiveness of the treatment for adhesively bonded structures, wedge tests were performed using aluminum that had been pre-treated with a phosphonic acid dip and the results compared with those obtained using non-inhibited aluminum. The control wedge test specimens were fabricated from 2024-T3 aluminum strips approximately 1"×6"×⅛" which had been prepared with the FPL treatment. The strips were bonded together using FM123-2 reinforced epoxy adhesive (a product of American Cyanamid) and cured at 250° F. The inhibited specimens were prepared in the same way except that after the FPL treatment the aluminum adherents were dipped in a 20% by weight aqueous solution of nitrilotris (methylene) triphosphonic acid at room temperature, rinsed thoroughly in distilled water and dried before bonding.

After such preparation, a wedge was driven into the bond line, the samples inserted into a humidity chamber whose environment was maintained at 140° F. and 95% R.H., and the crack extension rate measured as a function of exposure time. The test is designed to measure the durability of adhesively bonded structures in a humid environment.

Crack extension data for inhibited and non-inhibited specimens are shown in FIG. 4. Each curve represents the mean of data obtained from five specimens of each type. The inhibited samples performance is significantly superior to the controls which did not have the benefit of the phosphonic acid treatment. Since a correlation has been established between wedge test results and actual flight experience of aircraft hardware it is therefore expected that the inhibitor treatment would improve the long term service durability of adhesively bonded flight hardware to the significant degree measured in these tests.

While there have been described what at present are considered to be the preferred embodiments of this invention, it would be obvious to those skilled in the art that various changes and modifications may be made therein without departing from the invention. Accordingly, such modifications and changes are intended to be within the scope of the claims hereinafter appended.

We claim:

1. A method for improving the bond durability of an adhesively bonded aluminum substrate which comprises treating the surface of said aluminum substrate with an aqueous solution of an amino phosphonate compound having a plurality of phosphorous atoms.

2. A method as set forth in claim 1, wherein said aluminum substrate is covered with aluminum oxide.

3. A method as set forth in claim 2, wherein said phosphonate compound is selected from the group consisting of $NR_3$, $NHR_2$, $R'NR_2$, $(CH_2NR_2)_2$, and $R_2NCH_2CH_2NRCH_2CH_2NR_2$, wherein R is $CH_2PO(OH)_2$, and R' is a straight chain alkyl group having from 1 to 5 carbon atoms.

4. A method as set forth in claim 3, wherein said phosphonate compound is applied by spraying or dipping.

5. A method as set forth in claim 4, wherein the concentration of said compound is less than 50%.

6. A method as set forth in claim 5, wherein the concentration of said compound is from about 1 to about 500 ppm.

7. A method as set forth in claim 5, wherein said compound is present in a concentration of from about 10 to about 300 ppm.

8. A method as set forth in claim 7, wherein said compound is present in a concentration of about 150 ppm.

9. A method as set forth in claim 2, wherein said phosphonate is nitrilotris (methylene) triphosphonic acid.

10. A method as set forth in claim 9, wherein said phosphonate is present in a concentration of less than 50%.

11. A method as set forth in claim 10, wherein said phosphonate is present in a concentration of from about 1 to about 500 ppm.

12. A method as set forth in claim 11, wherein said phosphonate is present in a concentration of from about 10 to about 300 ppm.

13. A method as set forth in claim 12, wherein said phosphonate is present in a concentration of about 150 ppm.

14. A method as set forth in claim 10, wherein the temperature is maintained at less than 80° C. during said treatment.

15. A method for preparing aluminum surfaces for adhesive bonding, said method comprising providing a micro porous aluminum oxide surface, treating said aluminum oxide surface with an amino phosphonate compound having a plurality of phosphorous atoms, and drying.

16. A method as set forth in claim 15, wherein said micro porous aluminum oxide surface is provided by a process selected from the group consisting of Forest Product Laboratory and phosphoric acid anodization processes.

17. A method as set forth in claim 15, wherein said amino phosphonate compound is selected from the group consisting of $NR_3$, $NHR_2$, $R'NR_2$, $(CH_2NR_2)_2$, and $R_2NCH_2CH_2NRCH_2CH_2NR_2$, wherein R is $CH_2PO(OH)_2$, and R' is a straight chain alkyl group having from 1 to 5 carbon atoms.

18. A method as set forth in claim 17, wherein said amino phosphonate compound is applied by dipping or spraying in aqueous solution.

19. A method as set forth in claim 18, wherein said compound is present in a concentration of less than 50%.

20. A method as set forth in claim 19, wherein said compound is present in a concentration of from about 1 to about 500 ppm.

21. A method as set forth in claim 19, wherein said compound is present in a concentration of from about 10 to about 300 ppm.

22. A method as set forth in claim 19, wherein said compound is present in a concentration of about 150 ppm.

23. A method as set forth in claim 15, wherein said compound comprises nitrilotris (methylene) triphosphonic acid.

24. A method as set forth in claim 23, wherein said nitrilotris (methylene) triphosphonic acid is present in a concentration of less than about 50%.

25. A method as set forth in claim 23, wherein said nitrilotris (methylene) triphosphonic acid is present in a concentration of from about 1 to about 500 ppm.

26. A method as set forth in claim 23, wherein said nitrilotris (methylene) triphosphonic acid is present in a concentration of from about 10 to about 300 ppm.

27. A method as set forth in claim 23, wherein said nitrilotris (methylene) triphosphonic acid is present in a concentration of about 150 ppm.

28. A method as set forth in claim 27, wherein said aluminum oxide results from pretreatment of the aluminum surface by the Forest Product Laboratory process.

29. A method as set forth in claim 27, wherein said aluminum oxide results from pretreatment of the aluminum surface by the phosphoric acid anodization method.

30. A method for improving the corrosion resistance of aluminum by inhibiting the hydration of aluminum oxide by application of a corrosion inhibitor selected from the group consisting of $NR_3$, $NHR_2$, $R'NR_2$, $(CH_2NR_2)_2$, and $R_2NCH_2CH_2NRCH_2CH_2NR_2$, wherein R is $CH_2PO(OH)_2$, and R is a straight chain alkyl group having from 1 to 5 carbon atoms.

31. A method as set forth in claim 30, wherein the inhibitor is present in a concentration of less than 50% in water.

32. A method as set forth in claim 31, wherein said inhibitor is present in a concentration of from about 1 to about 500 ppm.

33. A method as set forth in claim 32, wherein said inhibitor comprises nitrilotris (methylene) triphosphonic acid.

34. A method as set forth in claim 31, wherein said inhibitor is applied to the aluminum surface by a method selected from the group consisting of dipping, spraying, and washing.

35. A method as set forth in claim 34, wherein said inhibitor is present in a concentration less than 500 ppm.

36. A method as set forth in claim 34, wherein said inhibitor is present in a concentration of about 150 ppm.

37. A bonded aluminum structure comprising one or more aluminum surfaces treated with an amino phosphonate corrosion inhibitor having a plurality of phosphorous atoms.

38. A bonded aluminum structure as set forth in claim 37, wherein said inhibitor is selected from the group consisting of $NR_3$, $NHR_2$, $R'NR_2$, $(CH_2NR_2)_2$, and $R_2NCH_2CH_2NRCH_2CH_2NR_2$, wherein R is $CH_2PO(OH)_2$, and R' is a straight chain alkyl group having from 1 to 5 carbon atoms.

39. A bonded aluminum structure as set forth in claim 38, wherein said inhibitor comprises nitrilotris (methylene) triphosphonic acid.

40. An aluminum substrate having a monomolecular layer thereupon of a hydration inhibitor comprising an amino phosphonate compound having a plurality of phosphorous atoms.

41. A substrate as set forth in claim 40, wherein said inhibitor is selected from the group consisting of $NR_3$, $NHR_2$, $R'NR_2$, $(CH_2NR_2)_2$, and $R_2NCH_2CH_2NRCH_2CH_2NR_2$, wherein R is $CH_2PO(OH)_2$, and R' is a straight chain alkyl group having from 1 to 5 carbon atoms.

42. An aluminum substrate as set forth in claim 40, wherein said inhibitor comprises nitrilotris (methylene) triphosphonic acid.

* * * * *